United States Patent [19]

Wolfgang

[11] 4,269,003

[45] May 26, 1981

[54] CENTRIFUGAL BLASTING MACHINE FOR LARGE WORKPIECES

[75[ Inventor: Wolfgang Walter, Hallau, Switzerland

[73] Assignee: Georg Fischer Aktiengesellschaft, Switzerland

[21] Appl. No.: 52,182

[22] Filed: Jun. 26, 1979

[30] Foreign Application Priority Data

Jun. 29, 1979 [CH] Switzerland ..... 7083/78

[51] Int. Cl.[3] ..... B24C 3/04; B24C 3/22

[52] U.S. Cl. ..... 51/421; 51/426; 51/433

[58] Field of Search ..... 51/419, 421, 426, 432, 51/433

[56] References Cited

U.S. PATENT DOCUMENTS

| | | | |
|---|---|---|---|
| 993,743 | 5/1911 | Wright | 51/426 |
| 1,857,188 | 5/1932 | Fulkerson | 51/426 |
| 1,875,994 | 9/1932 | Davis | 51/426 X |
| 1,887,395 | 11/1932 | Billings | 51/421 |
| 2,968,086 | 1/1961 | Fuchs | 51/419 |
| 3,604,157 | 9/1971 | Fogle | 51/426 X |

FOREIGN PATENT DOCUMENTS

| | | | |
|---|---|---|---|
| 1381811 | 1/1975 | United Kingdom | 51/421 |

*Primary Examiner*—Gary L. Smith

*Attorney, Agent, or Firm*—Roylance, Abrams, Berdo & Farley

[57] ABSTRACT

A machine for centrifugally blasting large surface and large volume workpieces (3) includes a closed blasting chamber (1), blast wheel units (5) and a supply arrangement (6) for the blasting agent. The blast wheel units and supply arrangement are disposed on an arm assembly (4) including two hinged arms (9, 10) movable in relation to the workpiece (3).

For simultaneously blasting multiple surfaces of the workpiece (3), the outside hinged arm (10 or 10*a*) is formed L- or U-shaped and has several blast wheel units (5) radially adjustable relative to the axis 12 of the hinged arm (10, 10*a*). The supply arrangement (6) for the blasting agent has rigid conveying arrangements (21, 27) which are swivelably interconnected to pivot about the axes (11, 12) of the arm (4).

11 Claims, 4 Drawing Figures

CENTRIFUGAL BLASTING MACHINE FOR LARGE WORKPIECES

This invention relates to a machine for centrifugally blasting large surface and large volume workpieces wherein a closed blasting chamber includes blasting medium propelling devices and means for feeding the blasting medium to the propelling devices, at least a portion of this apparatus being disposed on a support apparatus which is movable relatively to the fixed or rotatable workpiece.

BACKGROUND OF THE INVENTION

The general field with which this invention is concerned is in the area of treating the surfaces of articles being manufactured, particularly by casting, wherein a particulate material, known as the blasting medium, is forcefully hurled against the surfaces of workpieces to clean the surfaces or remove unwanted portions thereof. The general method of blasting in this fashion, and certain devices for accomplishing various kinds of blasting, are known and will not be described herein. The blasting medium itself is chosen to be consistent with the nature of the task to be performed and with the characteristics of the material from which the workpiece is made. The blasting medium can consist of relatively small abrasive particles or can be substantially spherical shot, but the specific characteristics of the blasting medium are of little significance to the invention disclosed herein.

Special problems are presented in treating the surfaces of workpieces which are particularly large in volume or surface area, and machines designed for handling numbers of small workpieces are simply not usable to handle the larger ones. A machine for dealing with relatively large workpieces is shown in German Offenlegungsschrift No. 25 25 761 wherein a blasting chamber contains a bracket which is disposed on a movable column, the bracket being vertically shiftable thereon. The bracket is designed to accomplish one symmetrical bending movement and a single blasting wheel for propelling the blasting medium, movable in two planes, is mounted on the bracket. With that apparatus it is not possible to simultaneously blast several surfaces, such as, for example, the peripheral and front surfaces, of a workpiece.

The large number of directions of movement required in that prior art apparatus imply a corresponding number of adjusting drive mechanisms which are exposed to the jets of blasting material, and also an expensive control and a flexible feed for the blasting medium to the blasting wheel, all of which increase the likelihood of difficulty in maintaining and operating the apparatus.

In addition, significant time is consumed in treating the surfaces of a large workpiece with that apparatus.

BRIEF DESCRIPTION OF THE INVENTION

Accordingly, an object of the present invention is to provide a centrifugal blasting machine of this general type which is capable of reliable operation, particularly as to the delivery of the blasting medium to the blast wheels, and will guarantee short blasting times even in the case of large volume workpieces.

Briefly described, the invention includes a machine for centrifugal blasting of workpieces having large volumes or surface areas, the machine having a closed blasting chamber and means for fixedly or rotatably supporting a workpiece therein, and wherein the machine comprises a first support bracket structure pivotably supported for movement about a first axis within the blasting chamber, a second support bracket structure pivotally supported on the first bracket structure for movement about a second axis which is movable with the first bracket structure, the second bracket structure having at least two angularly related carrier portions, a plurality of blasting wheel units mounted on the angularly related carrier portions of the second bracket structure for propelling blasting medium toward the workpiece, and means for feeding blasting medium to said blasting wheel units, said means including conveying conduits having substantially rigid portions extending to and between said first and second axes and swivel joints at said axes.

The second bracket structure can be made in either an L-shape or a U-shape, having a generally vertically extending portion and either one or two horizontally extending portions.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
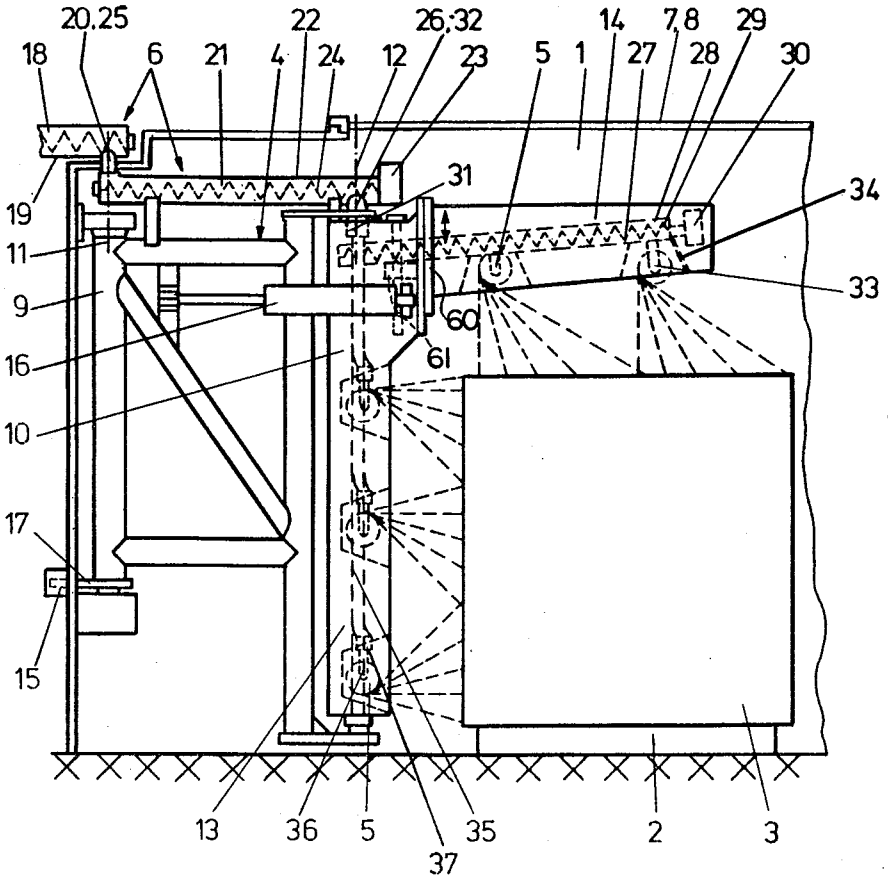
FIG. 1 is a schematic partial side elevation, in section, of a first embodiment of an apparatus in accordance with the invention.
Figure 2:
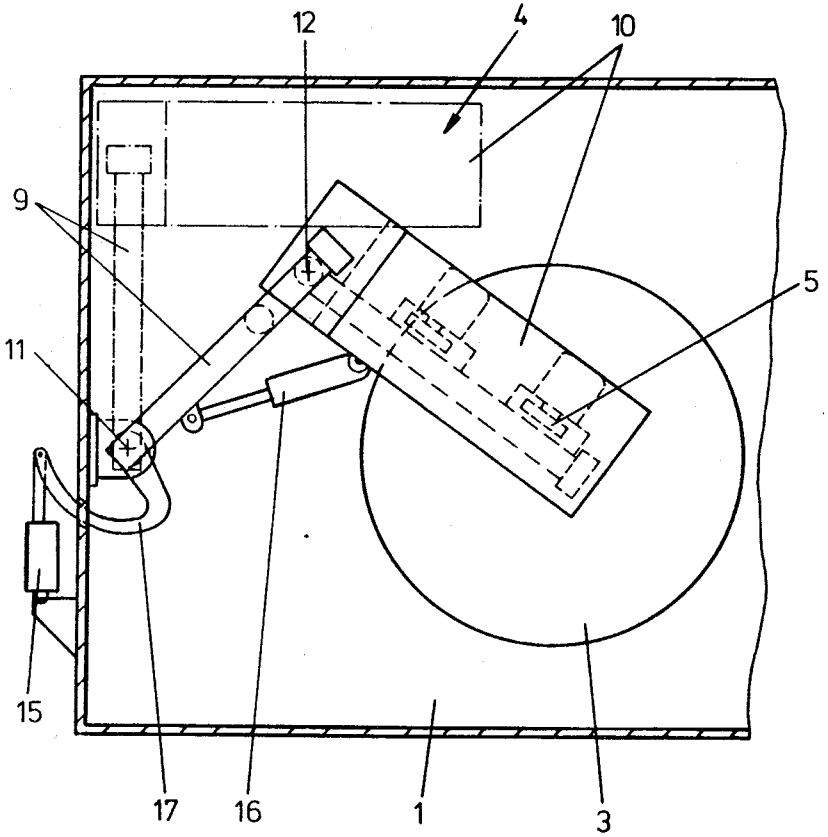
FIG. 2 is a top plan view of the apparatus of FIG. 1, also partially in section.

Referring now to the drawings in detail, the centrifugal blasting machine, or jet blasting machine, shown in the sectional views of FIGS. 1 and 2 includes a blasting chamber 1, a locally fixed supporting table 2 for workpieces 3, the table being a rotatable table to present various aspects of the workpiece to the blasting medium, a bracket structure indicated generally at 4 with blasting wheels disposed thereon, and a supply arrangement indicated generally at 6 to supply the blasting medium to the blasting wheels. As will be recognized, the chamber 1 constitutes an essentially closed housing, only a portion of which is shown in the figure, to prevent the escape of the blasting medium. The blasting wheels themselves are centrifugal impeller devices which are normally rotatable wheels with radially extending blades which throw the blasting medium with considerable force toward the workpiece as illustrated generally by the fan-shaped dashed lines in FIG. 1.

The top of the blasting chamber is provided with an aperture 8 which is closable by means of a hinged lid 7, through which aperture the workpieces 3 can be lowered onto the supporting table 2. Alternatively, the workpieces can be moved into the chamber by means of a hauling cart through a suitable access opening.

The arm or bracket structure 4 includes two hinged bracket assemblies 9 and 10 of which the inner, or leftmost arm 9, as shown in FIG. 1, is swivably or pivotally mounted for rotation about a vertical axis 11 on an end wall of the blasting chamber. It will be recognized, however, that it is quite possible to pivotably support arm 4 on a support structure or holding arrangement which is completely independent of the wall of the blasting chamber. The outside, or right-hand arm 10, shown as an angular structure, is swivelably or pivotably supported on arm 9 for pivotal movement about an axis 12, arm 10 including a vertical carrier portion 13 and a horizontal, or substantially horizontal, carrier portion 14, the carriers being preferably formed as box-shaped structures in cross-section. On the vertical carrier portion 13 a plurality of blasting wheels, preferably three in number, are mounted at mutually equal distances from axis 12. On the horizontal carrier 14 at least one, but preferably two or more, blasting wheels are supported, these blasting wheels being mounted in fixed radial distances with respect to axis 12.

The swiveling movements of the hinged arms 9 and 10 are accomplished by means of adjusting drives 15 and 16 which can be electromechanical spindle drives or hydraulic piston and cylinder assemblies. The adjusting drive 15 for the inside hinged arm 9 includes an arc-shaped lever 17 which projects through the wall of blasting chamber 1 to permit the adjusting drive 15 to be disposed outside of the blasting chamber 1 in a position which is protected from deleterious effects of the blasting medium. The arc-shaped form of the lever 17 makes it possible to provide a seal between the lever and the wall of the blasting chamber as will be apparent from FIG. 2. The second adjusting drive 16 can be protected from the jets of blasting material by simple means such as, for example, guard plates, not shown.

A conveying arrangement 18 which is part of feed arrangement 6 for the blasting medium leads from a processing plant to the sealing of blasting chamber 1. The processing plant for the treatment of the blasting agent is conventional and is not illustrated. The blasting medium is conveyed through a conveying pipe 19 of the conveying arrangement 18 to an exit aperture 20 which is disposed concentrically relative to swiveling axis 11. A further conveying arrangement 21 is mounted so as to be swivelable with hinged arm 9 and is supported on that arm, conveyor 21 including a conveying conduit 22 and a screw conveyor 24 disposed therein which can be driven by a drive 23. The conveyor conduit 22 has an exit aperture 26 concentric with the axis 12 and an inlet aperture 25 concentric with axis 11.

Figure 4:
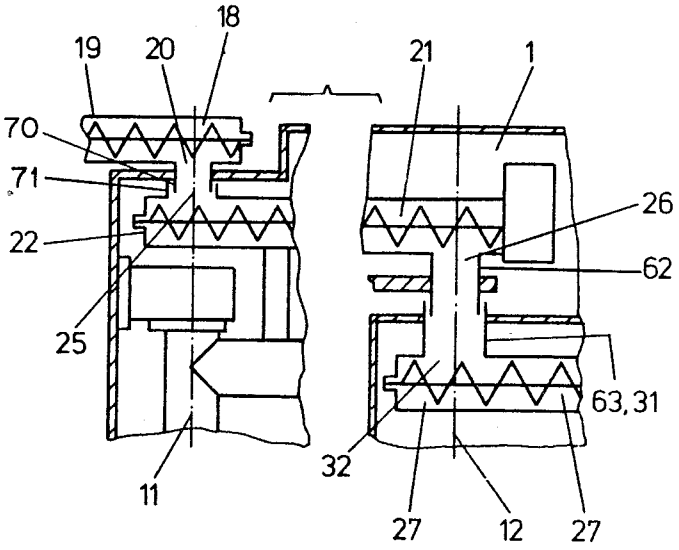
FIG. 4 is an enlarged fragmentary partial foreshortened sectional view of portions of the feed mechanism apparatus of FIG. 1.

On or in the horizontal carrier 14 of the outside hinged arm 10 is provided a conveying arrangement 27 which includes a conveying conduit 28, a screw conveyor 29 and a drive 30, this assembly being mounted on carrier portion 14 for swiveling movement therewith. An intermediate tank 31, fixedly connected with conveyor pipe 28, has an inlet aperture 32 which is disposed concentrically with axis 12. In order to accomplish a transfer of the blasting medium without loss of the medium from one conveying arrangement 18 or 21 to the next conveying arrangement 21 or 27, telescoped pipes 70 and 71 or 62 and 63 are mounted on the conveyor pipe 19, 22 and 27 concentrically with the pivot axis 11 and 12 as can be seen in FIG. 4. The intermediate tank 31 which is shown as a portion of pipe 63 can be disposed, as shown in FIG. 1, concentrically with conveyor pipe 28 or laterally thereof, in which case the axis of the worm conveyor 29 is disposed laterally from the axis 12. Individual supply pipes 33 which, for the purpose of dosing the blasting medium, are provided with replaceable aperture partitions and lead from the conveyor pipe 28 to the fan blower units 5 disposed in carrier 14. By this technique, predeterminable quantities of the medium are fed from the conveyor conduits to the blasting wheels.

At the end of the conveyor conduit 28 adjacent the drive means therefor, an overflow pipe 34 has been disposed in order to carry off excess blasting medium into chamber 1.

From the intermediate tank 31 a pipe 35 branches off into the vertical carrier 13 through which the blasting wheel units 5 disposed therein are supplied with blasting medium through supply pipes 36, dosing valves 37 being disposed in those supply pipes 36 for the purpose of uniformly alloting blasting medium to the blast wheel units. Blasting medium which is not needed is similarly carried off by way of an overflow into the blasting chamber.

As will be seen from FIG. 2, the arm 4 is moved into the lateral position illustrated in dash-dot lines in order to load a workpiece into the blasting chamber without interference with the movable blast wheel supporting structure. Subsequently, the blast wheel units 5 are moved into the operating position by swiveling arm 4 to a position dependent upon and consistent with the dimensions of the workpiece to be treated. It will be recognized that both the distance to the workpiece as well as the angle of impact of the blasting jets can be optimally adjusted because of the fact that it is possible to pivot the two hinged arms 9 and 10 independently of each other. Thus, the peripheral sides as well as the upper surface of the rotating workpiece can be blasted simultaneously.

In a situation in which it is contemplated that successive workpieces to be treated will be of somewhat different heights, it is advantageous to mount the horizontal carrier portion such that it is vertically adjustable along the vertical carrier portion 13. The horizontal carrier portion 14 is mounted in guides 60 on the vertical carrier portion 13 and can be vertically adjustable or shiftable in relation to the workpiece by means of a spindle 61.

Figure 3:
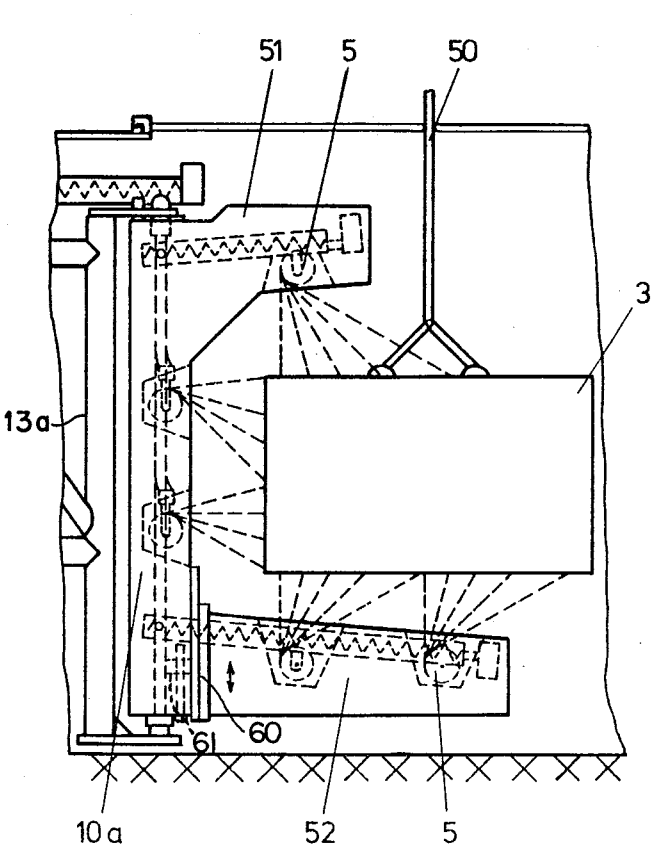
FIG. 3 is a schematic partial side elevation of a further embodiment of an apparatus in accordance with the invention, in partial section, the top thereof being removed.

A further embodiment of an apparatus in accordance with the invention is shown in FIG. 3, this embodiment being particularly advantageous in treating a workpiece which is to be blasted while suspended from a conventional suspending mechanism 50. In this embodiment, the outside hinged arm **10*a* is formed with two horizontally extending portions, thereby defining a generally U-shaped structure, the upper carrier portion 51 with at least one blast wheel unit being shorter than the lower horizontally extending carrier portion 52 which as shown, can have two or more blast wheel units 5. With this latter embodiment, the workpieces can be simultaneously blasted on the upper and lower surfaces and the vertically extending or side surfaces. It will also be recognized that the embodiment of FIG. 3 can be further modified by making the lower, longer horizontally extending carrier portion vertically shiftable or adjustable in guides 60 and by means of a spindle or with respect to the vertical portion 13*a***.

As a result of the angular or U-shaped form of the outside hinged arm of the bracket according to the invention with the mounting of several blast wheel units thereon, the peripheral sides together with one or both front sides can be blasted simultaneously, making short blasting times possible. As a result of the use of a bracket with two mutually independent swivelably hinged arms, there results a good and simple adjustability of the blast wheels with respect to workpieces of various sizes and with regard to an optimum striking angle of the blasting jets on the surfaces of the workpiece. As a result of the development in accordance with the invention of elements of the supply mechanism for the blasting agent as conveying conduits which are, in themselves, rigid but which are swivelable about the axes of the brackets as well as due to the fact that only two adjusting drives are needed, one of which is disposed outside of the blasting chamber, the susceptibility to breakdown of a centrifugal blasting machine having movable blast wheel units is considerably decreased.

A further advantage of the apparatus consists in the fact that blast wheels and the supply of blasting agent can be assembled and constructed practically independently of the blasting housing or chamber or the characteristics thereof, i.e., the chamber wall does not need to perform a supporting function.

While certain advantageous embodiments have been chosen to illustrate the invention, it will be understood by those skilled in the art that various changes and modifications can be made therein without departing from the scope of the invention as defined in the appended claims.

What is claimed is:

1. A machine for centrifugal blasting of workpieces having large volumes or surface areas, the machine having a closed blasting chamber and means for fixedly or rotatably supporting a workpiece therein, and wherein the machine comprises a first support bracket structure pivotally supported for movement about a first axis within the blasting chamber;

a second support bracket structure pivotally supported on said first bracket structure for movement about a second axis movable with said first structure, said second bracket structure having at least two angularly related carrier portions;

a plurality of blasting wheel units mounted on said angularly related carrier portions of said second bracket structure for propelling blasting medium toward the workpiece; and means for feeding blasting medium to said blasting wheel units, said means including conveying conduits having substantially rigid portions extending to and between said first and second axes and swivel joints at said axes.

2. A machine according to claim 1 wherein said second bracket structure includes a substantially vertical portion and a substantially horizontal portion extending from one end of said vertical portion.

3. A machine according to claim 2 wherein said vertical portion extends parallel to said second axis and at least two of said blasting wheel units are mounted on said horizontal portions, each of said units mounted in fixed but radially different positions relative to said second axis.

4. A machine according to claim 1 wherein said second bracket structure includes a substantially vertical portion and two generally horizontal portions, one extending from each end of said vertical portion, each of said portions supporting at least one of said blasting wheels.

5. A machine according to claim 1 and further comprising first and second drive means for pivotally adjusting the angular positions of said first and second brackets, respectively.

6. A machine according to claim 4 wherein said second bracket structure includes a substantially vertical portion parallel with and translatable about said second axis, and a generally horizontal portion extending from said vertical portion, and wherein at least two of said blasting wheel units are mounted on said horizontal portion, each in a radially different but fixed position relative to said second axis.

7. A machine according to claim 3 or 6 wherein said horizontal portion is vertically adjustable along said vertical portion.

8. A machine according to claim 5 wherein at least one of said drive means is mounted outside of said chamber.

9. A machine according to claim 1 wherein said conveying conduits further include screw conveyors therein.

10. A machine according to claim 9 wherein said conveying pipes have means defining apertures concentrically aligned with said first and second axes.

11. A machine according to claim 9 wherein adjacent ends of said conduits are provided with telescopingly mated outlet and inlet pipes concentrically disposed relative to said axes.

* * * * *